US007540489B2

(12) United States Patent
Kushida

(10) Patent No.: US 7,540,489 B2
(45) Date of Patent: Jun. 2, 2009

(54) SHEET FEEDING DEVICE AND IMAGE FORMING APPARATUS

(75) Inventor: Hideki Kushida, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 11/870,152

(22) Filed: Oct. 10, 2007

(65) Prior Publication Data

US 2008/0088078 A1 Apr. 17, 2008

(30) Foreign Application Priority Data

Oct. 13, 2006 (JP) ..... 2006-280658

(51) Int. Cl.
*B65H 3/14* (2006.01)
*B65H 3/34* (2006.01)
*B65H 1/00* (2006.01)

(52) U.S. Cl. ..... 271/98; 271/104; 271/171; 271/145

(58) Field of Classification Search ..... 271/97, 271/98, 104, 171
See application file for complete search history.

(56) References Cited

U.S. PATENT DOCUMENTS 5,135,213 A * 8/1992 Malachowski et al. ..... 271/104
5,247,337 A * 9/1993 Malachowski ..... 399/76
5,893,554 A * 4/1999 Okahashi et al. ..... 271/98
6,409,165 B1 * 6/2002 Yamaoka et al. ..... 271/145
7,198,264 B2 * 4/2007 Kashiba et al. ..... 271/11
7,288,059 B2 10/2007 Ikeda et al. ..... 493/444
2005/0082735 A1 4/2005 Nakamura et al. ..... 271/1
2005/0084308 A1 4/2005 Nakamura et al. ..... 399/407
2005/0179190 A1 8/2005 Kamiya et al. ..... 270/58.07
2006/0017209 A1 1/2006 Kushida et al. ..... 270/37
2006/0017218 A1 1/2006 Kawata et al. ..... 271/207
2006/0279037 A1 12/2006 Kushida et al. ..... 270/58.08
2007/0035082 A1 2/2007 Kushida ..... 270/58.12
2007/0045924 A1 3/2007 Kamiya et al. ..... 270/58.1
2007/0161489 A1 7/2007 Ikeda et al. ..... 493/444

FOREIGN PATENT DOCUMENTS

JP 5-178483 7/1993
JP 06080261 A * 3/1994

* cited by examiner

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

The position of a sheet accommodated in a sheet storage portion is restricted by a restricting member provided movably on a sheet storage portion. This restricting member has a holding portion which is movable freely and is attached detachably to the sheet storage portion so as to hold the restricting member at a restricted position corresponding to a sheet size. The end portion of the sheet whose rear end position is restricted is pressed from above by a pressing member provided movably in a vertical direction on the end portion restricting member. Then, to move the restricting member, an operation portion is operated and the holding portion is moved in a direction of releasing the engagement and the pressing member is raised upward of accommodated sheets.

8 Claims, 20 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, and more particularly to a restricting member for restricting the end portion of sheets accommodated in a sheet storage portion.

2. Description of the Related Art

Conventionally, the image forming apparatus such as a copying machine, electrophotographic printer, ink jet printer, facsimile machine, printing machine is equipped with a sheet feeding device for feeding sheets one by one from a sheet storage portion which accommodates a plurality of sheets.

Generally, such a sheet feeding device feeds sheets stacked on a sheet stack tray by rotation friction of sheet feeding rollers whose surface is composed of rubber or the like. In this type, the feeding performance largely depends on friction coefficient of the surface of the sheet feeding roller. Therefore, there are disadvantages such as instability of sheet feeding performance due to changes in friction coefficient of the sheet feeding roller surface because of changes in external shape by friction of the feeding roller, changes of material with a time passage, adhesion of paper powder and the like and inability of meeting sheets having a different surface condition.

Recently, an air suction type sheet feeding device is proposed to convey sheets stacked on a sheet stack tray by suction force of air and feeding force of endless belt.

In this air suction type, air is blown against an end face of sheets stacked on the sheet stack tray with an air blowing means so as to form air layer between sheets, so that the sheet is floated thereby weakening adhesion force between the sheets. In the meantime, according to some air suction type, floating of the sheet accompanied by air blowing is restricted with a sheet pressing member at a specified position so as to allow air entering between the sheets to flow through, whereby weakening adhesion force between the sheets.

When air layer is formed between the sheet layers in this way, resistance between a floated sheet on a top layer and non-floated other sheet decreases. Thus, when the topmost sheet is fed with the feeding roller after it is conveyed by an endless belt by suction, a next sheet could be conveyed in an overlapping condition.

Thus, installation of a rear end pressing member which presses the rear end side of the stacked sheets from above is considered in order to prevent the next sheet from being conveyed in the overlapping condition. The technology of this rear end pressing member has been described in Japanese Patent Application Laid-Open No. 05-178483.

The rear end pressing member is sometimes provided on a rear end restricting member for restricting the rear end of the sheet in order to press the rear end portion of the sheet. This rear end restricting member needs to be moved along the end portion of the sheet by releasing fixing thereof each time corresponding to the size of stacked sheets when the size of the sheet is changed.

If sheets are stacked up to a height larger than the bottom-most position of the rear end pressing member when the rear end restricting member is moved, unless the rear end pressing member is raised, the sheets could be set such that the front end of the rear end pressing member contacts an end face of the stacked sheets.

For example, when the rear end restricting member is changed to a position corresponding to a sheet of smaller size from a position corresponding to a sheet of a larger size, the rear end restricting member is often adjusted to the rear end of the sheets after the sheet stack is set. In this case, unless the rear end pressing member is raised, the sheets could be set in an erroneous condition in which the front end of the rear end pressing member butts against the end face of the sheet stack.

Consequently, the rear end pressing member does not make contact with the topmost sheet from above and thus the top layer sheet are not pressed and might be conveyed easily in an overlapping condition. Further, because the rear end restricting member does not contact the rear end face of sheets, the position of the sheet in a feeding direction may be dispersed, thereby causing a deviation of sheet feeding timing when the sheet is picked up.

SUMMARY OF THE INVENTION

Accordingly, the present invention has been achieved in views of such a present situation and an object of the invention is to provide a sheet feeding device and an image forming apparatus capable of improving an ease of setting of the restricting member having the rear end pressing member.

To achieve the above described object, the present invention provides a sheet feeding device for feeing a sheet while loosening the sheet by blowing air to end portions of the stacked sheets accommodated in the storage portion, comprising:

a restricting member provided movably in the sheet storage portion which restricts the position of the stacked sheets accommodated in the sheet storage portion; a holding portion which holds the restricting member at a restricting position corresponding to a sheet size of the stacked sheets; a pressing members provided movably in the vertical direction on the restricting member so as to press the top face of the stacked sheets restricted by the restricting member; and a release mechanism which releases holding of the restricting member by the holding portion to move the restricting member and moves the pressing member upward from the top face of the stacked sheets.

DESCRIPTION OF THE EMBODIMENTS

Hereinafter, a preferred embodiment for carrying out the present invention will be described in detail with reference to the accompanying drawings.

Figure 1:
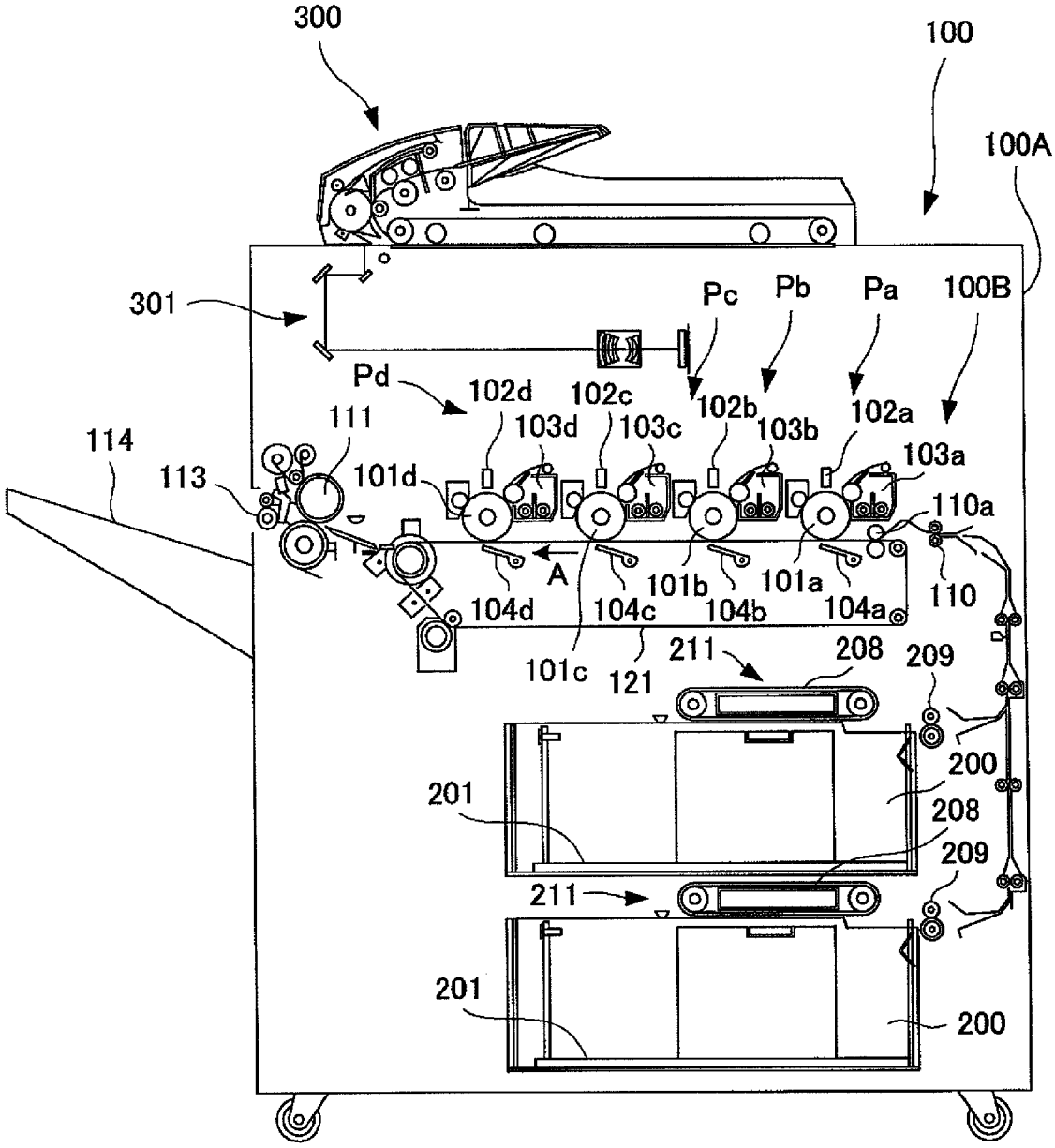
FIG. 1 is a diagram showing a schematic structure of a color laser printer which is an example of an image forming apparatus equipped with a sheet feeding device according to an embodiment of the present invention.

FIG. 1 is a diagram showing a schematic structure of a color laser printer which is an example of an image forming apparatus equipped with a sheet feeding device according to the embodiment of the present invention. In FIG. 1, a color laser printer 100, a color laser printer main body 100A (hereinafter referred to as printer main body), an image reading portion 300 and a scanner 301 are shown.

This printer main body 100A includes an image forming portion 100B for forming an image on a sheet and a sheet feeding device 21 for feeding the sheet to the image forming portion 100B.

The image forming portion 100B is provided with process stations Pa-Pd for forming four colors of toner images, yellow (Y), magenta (M), cyan (C) and black (Bk). The process stations Pa-Pd include photosensitive drums 101 (101*a*-101*d*) which are image bearing members which carry four colors of the toner images of yellow, magenta, cyan and black and driven by an ultrasonic motor (not shown).

Further, each of the process stations Pa-Pd includes development units 103 (103*a*-103*d*) which forms toner images by applying toners of yellow, magenta, cyan and black to an electrostatic latent image formed on a photosensitive drum. Further, each thereof has a charging roller 102 (102*a*-102*d*) for charging the surface of the photosensitive drum equally.

A transfer belt 121 which contacts each photosensitive drum 101 is provided under each photosensitive drum 101. An exposure device (not shown) constituted of a LED or the like is disposed above the photosensitive drum 101. A fixing device 111 is provided in the downstream of the process stations Pa-Pd.

A sheet feeding device 211 includes a sheet storage portion 200 and a sheet feeding portion 208 which is disposed above the sheet storage portion 200 to suck and convey a sheet accommodated in the sheet storage portion 200. The top layer of sheets accommodated in the sheet storage portion 200 is loosened by sucking air from a fan (not shown) which communicates with a suction conveyance belt 213 shown in FIG. 2 described later, so that they are sucked one by one and conveyed by a conveyance roller pair 209 provided in the downstream.

In the meantime, the sheet storage portion 200 is mounted to the printer main body 100A such that it can be drawn out. For example, when sheets are replenished or jamming generated in the sheet feeding device is treated, the sheet storage portion 200 is drawn in the forward direction in FIG. 2.

When the image formation operation is started in such a color laser printer 100, laser beam is projected from the exposure device to the photosensitive drum 101 whose surface is charged by the charging roller 102 equally, based on read information from the scanner 301 of the image reading portion 300.

Consequently, toner latent images of yellow (Y), magenta (M), cyan (C) and black (Bk) are formed on the photosensitive drum and after that, this latent image is developed with the development unit 103. As a result, toner images of yellow, magenta, cyan and black are formed in succession on the photosensitive drum.

In parallel with this toner image formation operation, a sheet (not shown) accommodated in the sheet storage portion 200 is sucked and conveyed by the suction conveyance belt 213 (see FIG. 2) and then, conveyed by the conveyance roller pair 209. After that, skew feeding of the sheet is corrected while being introduced by a stopped resist roller pair and further, placed on a transfer belt 121 synchronously with the image formation operation by a rotation of the resist roller pair 110.

Then, the sheet is conveyed in a direction to each transfer portion in which the photosensitive drum 101 and the transfer belt 121 make a firm contact with each other by a rotation of the transfer belt 121 in a condition in which it is pressed against the transfer belt 121 by a pressing roller 110*a* held by a pressurization arm (not shown).

Toner image of respective colors are transferred to the sheet transferred to each transfer portion such that they overlap successively by actions of the transfer blades 104 (104*a*-104*d*) which are disposed on each transfer portion and supplied with toner and opposite-polarity voltage. After four colors of the toner images are transferred to the sheet such that they overlap successively, the sheet is separated from the front end in the conveyance direction at a bent portion of the transfer belt 121 and conveyed to the fixing device 111.

Next, the sheet is heated and pressurized by the fixing device 111 so that toners of respective colors on the sheet are fixed to the sheet such that they are mixed by melting. As a result, a full-color print image is fixed on the sheet as a permanent image. A sheet on which the toner image is fixed is discharged onto the discharge tray 114 by a conveyance roller 113.

Figure 2:
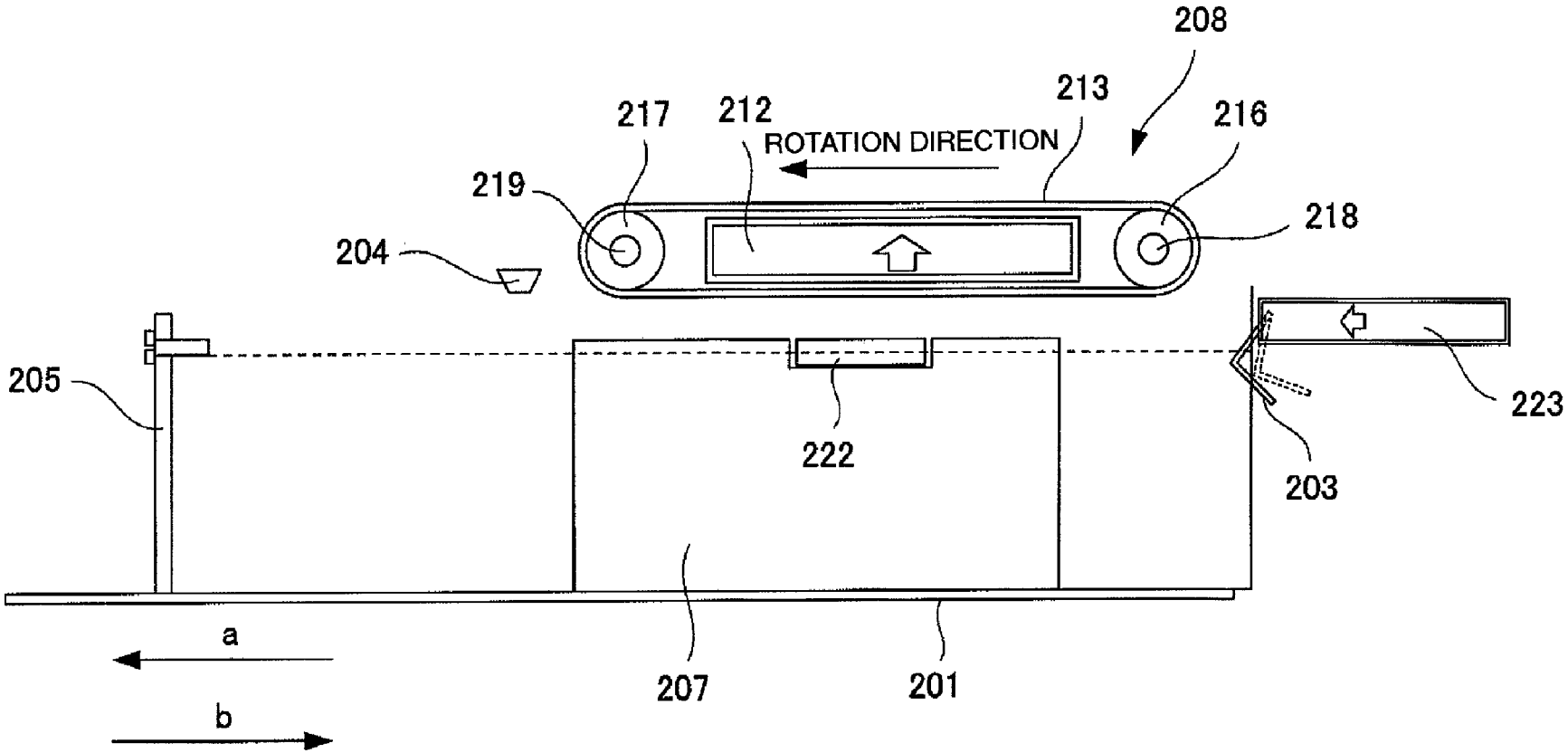
FIG. 2 is a front sectional view of the sheet feeding device.
Figure 3:
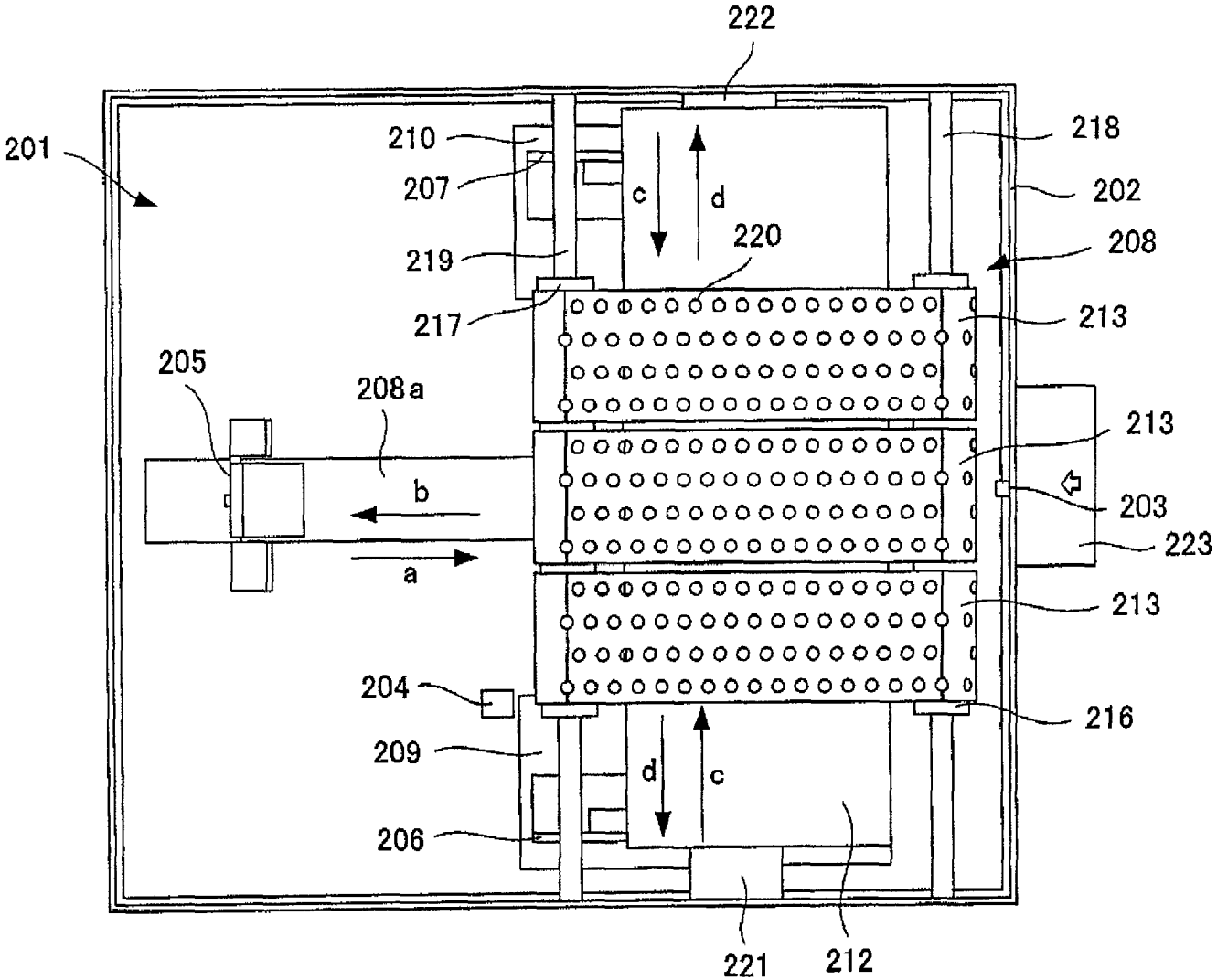
FIG. 3 is a top view of the sheet feeding device.
Figure 4:
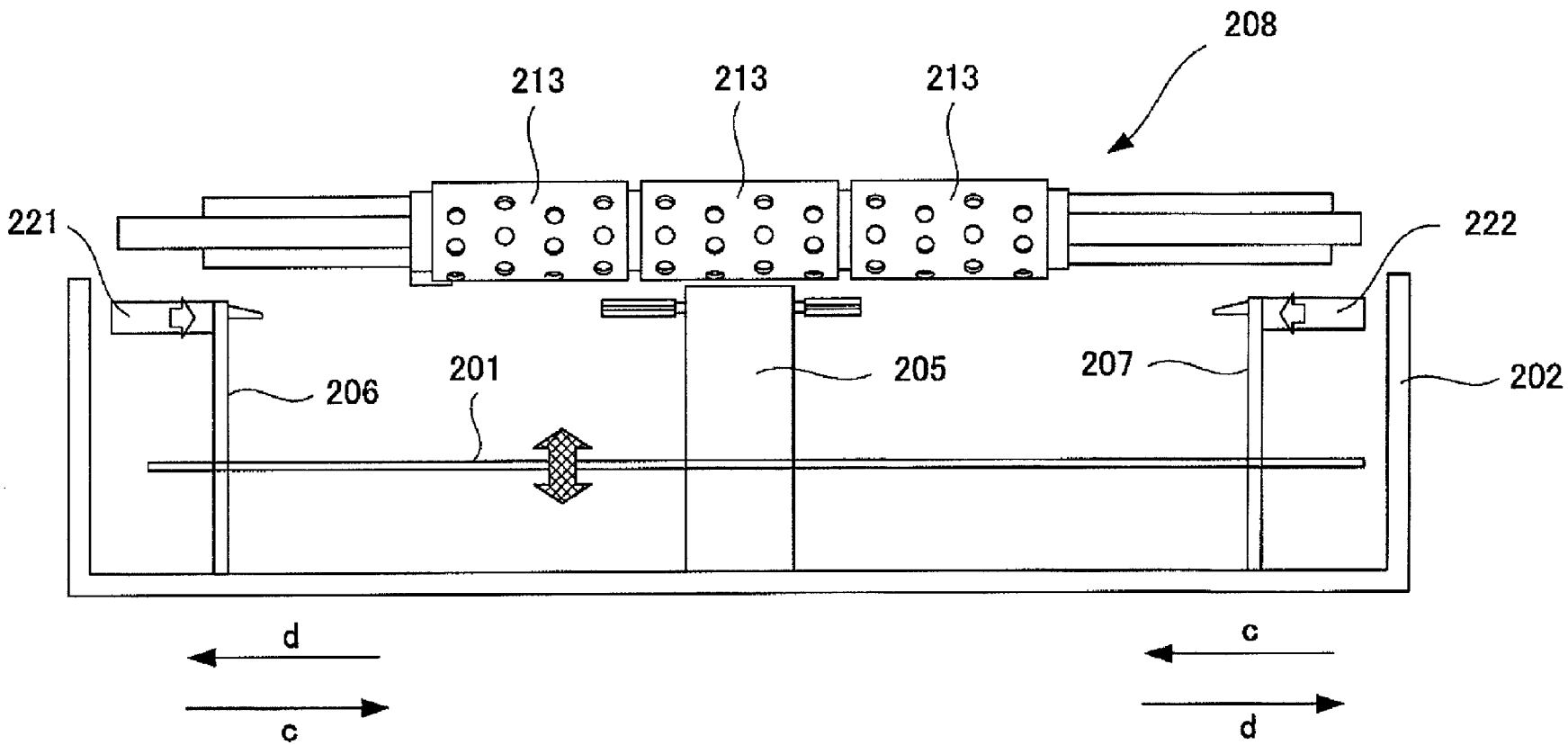
FIG. 4 is a side sectional view of the sheet feeding device.

Next, the structure of the sheet feeding device 211 will be described with reference to FIGS. 2 to 4. FIG. 2 is a front sectional view of the sheet feeding device 211, FIG. 3 is a top view thereof and FIG. 4 is a side sectional view thereof.

The sheet feeding device 211 includes the sheet storage portion 200 for accommodating sheets, the sheet feeding portion 208 for conveying sheets accommodated in the sheet storage portion 200 by suction, a sheet level detection sensor 203, an upper limit detection sensor 204 and the like.

The sheet storage portion 200 includes a box-like frame member 202 and a tray 201 which is provided movably in the vertical direction within the frame member and lifted up/down by a lifting mechanism (not shown).

In the tray 201, feeding of the sheet is carried out successively and when the level of the topmost sheet S1 shown in FIG. 5 described later is lifted down to a level which is not detected by the sheet level detection sensor 203, the topmost sheet S1 is lifted up until it is detected by the sheet level detection sensor 203. Further, if the topmost sheet S1 is lifted up beyond the level which is detected by the sheet level detection sensor 203, it is stopped when it is detected by the upper limit detection sensor 204.

The sheet storage portion 200 is provided with a rear end restricting member 205 as an end restricting member for restricting the rear end position of the stacked sheets on the tray such that it can be moved in sheet feeding directions indicated with arrows a, b. Further, width direction restricting members 206, 207 for restricting the position of the stacked sheets in a direction perpendicular to the sheet feeding direction (hereinafter referred to as width direction) are provided such that they can be moved in width directions indicated with arrows c, d in FIG. 4.

Provision of the rear end restricting member 205 and the width direction restricting members 206, 207 enables sheets of plural sizes to be stacked selectively on the tray. In the meantime, the rear end restricting member 205 and the width direction restricting members 206, 207 are disposed in opening portions 208*a*-210 formed in the tray 201 such that they can be moved without any interference with the lifting motion of the tray 201.

As shown in FIG. 3, the sheet feeding portion 208 includes a sheet suction duct 212 for sucking the topmost sheet of sheets stacked on the tray and plural endless suction conveyance belts 213 for conveying the sheets such that they are sucked by the sheet suction duct 212. In the meantime, the sheet suction duct 212 is provided in the width direction and fixed to the top end of the frame member 202 through supporting member (not shown).

The suction conveyance belts 213 are wound around a drive roller 216 and a driven roller 217, disposed across the sheet suction duct 212, at an identical interval such that the suction duct 212 is covered thereby. Roller shafts 218, 219 of the drive roller and driven roller 216, 217 are mounted to the frame member 202 in parallel to a supporting member (not shown) such that they can be rotated.

An air suction hole (not shown) is formed in a portion corresponding to each suction conveyance belt 213 of the suction duct 212 and a plurality of air suction holes 220 are formed in the entire periphery of the suction conveyance belt 213. A negative pressure generation source (pump or fan) (not shown) is connected to the sheet suction duct 212.

When a shutter (not shown) is opened with the negative pressure generating source driven, vacuum condition is produced in the sheet suction duct 212 so as to generate suction force. Consequently, air below the suction conveyance belt 213 is sucked through an opening and air suction holes 220 corresponding to each suction conveyance belt 213, so that the topmost sheet located at a level which is detected by the sheet level detection sensor 203 is sucked by the suction conveyance belt 213.

A front end separation duct 223 for spouting separation air to the front end portion of a sheet stack is provided on the side wall face on a downstream side in the sheet feeding direction of the frame member 202 as shown in FIG. 2. As shown in FIG. 4, side separation ducts 221, 222 for blowing air to the side end of the sheet stack are disposed on forward and deep sides such that they oppose each other in the vicinity of the width direction restricting members 206, 207 in the width direction of the frame member 202.

An identical negative pressure generation source (fan) (not shown) is connected to the front end separation duct 223 and the side separation ducts 221, 222 and by opening/closing a shutter (not shown), air flow is generated within the duct as indicated with an arrow in FIG. 2 and FIG. 4.

Openings of the front end separation duct 223 and side separation ducts 221, 222 are provided around a position in height which allows the topmost sheet S to be sucked by the sheet suction duct 212.

Figure 5:
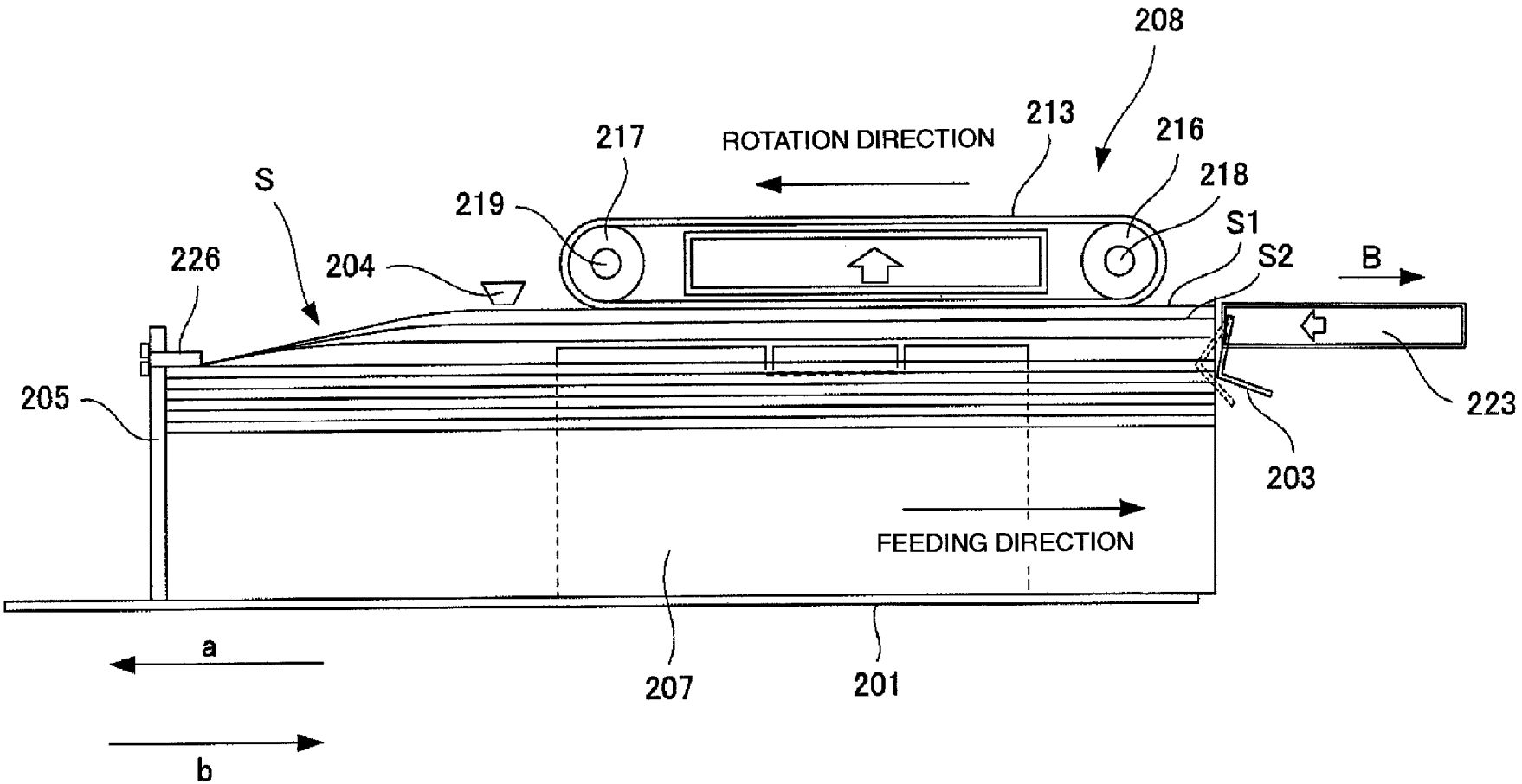
FIG. 5 is a front sectional view showing sheet feeding operation of the sheet feeding device.

By providing an opening at such a position, air flow can be generated effectively between the topmost sheet S1 and a second sheet S2 from the topmost one as shown in FIG. 5 when the sheet is fed. Consequently, the sheet can be loosened securely so that separation between the topmost sheet S1 and the second sheet located just below can be improved.

Figure 6:
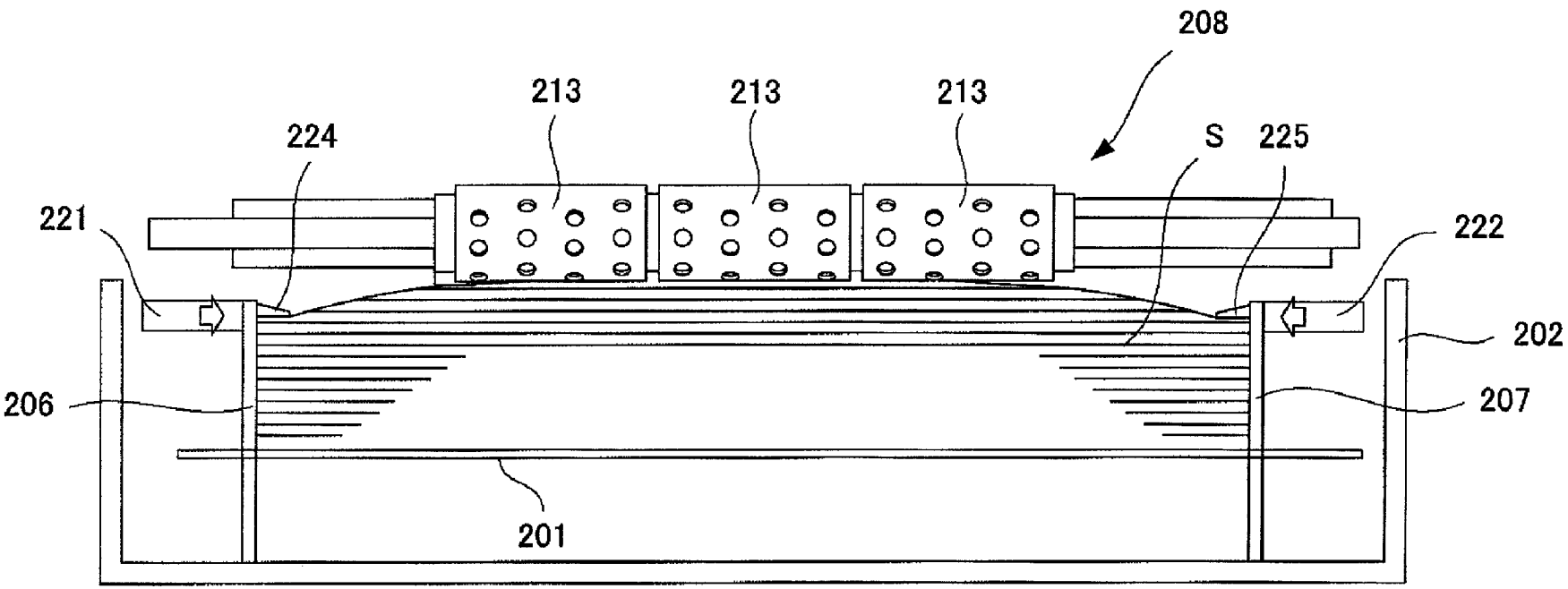
FIG. 6 is a side sectional view showing sheet feeding operation of the sheet feeding device.

FIGS. 5, 6 show a condition in which the topmost sheet S1 is sucked against the suction conveyance belt 213 by a suction force of the sheet suction duct 212 and the sheet separation force of the side separation ducts 221, 222.

When the sheet is sucked by the suction conveyance belt 213, the topmost sheet S1 is sucked by the suction conveyance belt 213 in the vicinity of the front end because the sheet suction duct 212 is disposed near the front end in the sheet feeding direction on the tray 201. Thus, the rear end portion not sucked by the sheet suction duct 212 droops downward with respect to a suction position of the suction conveyance belt 213 as shown in FIG. 5.

As shown in FIG. 5, the rear end restricting member 205 is provided with a rear end pressing member 226 for pressing the rear end portion of the sheet S1 to prevent the rear end side of the sheet S1 raised to a level detected by the sheet level detection sensor 203 from being floated. Further, the width direction restricting members 206, 207 are provided with side pressing members 224, 225 for pressing both side end portions of the sheet S1 to prevent both sides in the width direction of the topmost sheet S1 raised to the level detected by the sheet level detection sensor 203 from being floated.

Consequently, when the topmost sheet is floated by sheet separation force of the front end separation duct 223 and the side separation ducts 221, 222, the both side end portions of the sheet S1 are pressed by the side pressing members 224, 225 and the rear end portion of the sheet S1 is pressed by the rear end pressing member 226. Therefore, when only a central portion in the width direction of the topmost sheet S1 is separated and sucked against the suction conveyance belt 213, a gap portion is formed between the topmost sheet S1 and the second sheet S2.

Air spouted from the front end separation duct 223 and the side separation ducts 221, 222 flows between the topmost sheet S1 and the second sheet S2 of this gap portion and moves in a region between the rear end pressing member 226 and the side pressing members 224, 225, forming a substantially pocket shape whose both sides and rear end are closed. Consequently, the topmost sheet S1 and the second sheet S2 can be separated securely from its sheet front end to its sheet rear end.

Even if breaking or curl facing upward or downward is present at the sheet front end of the topmost sheet S1, the curl is corrected because both side portions in the width direction of the sheet S1 are pressed by the side pressing members 224, 225. Thus, the substantially pocket shape is formed so that the sheet front end is open.

When the suction conveyance belt 213 is driven in the direction of an arrow B shown in FIG. 5 after the sheet S is sucked against the suction conveyance belt 213, the topmost sheet S1 is conveyed in the downstream. At this time, as shown in FIGS. 7(*a*), (*b*), the sheet S1 moves, sliding on the bottom face of the rear end pressing member 226.

At this time, the relationship between dynamic friction μp generated between the rear end pressing member 226 and a sheet S1 or a sheet S2, dynamic friction μs generated between the sheet S1 and the sheet S2, conveyance force F of the suction conveyance belt and mass N of the rear end pressing member needs to be expressed as shown below.

$$F>\mu p\sim N>\mu s\cdot N$$

Figure 7A:
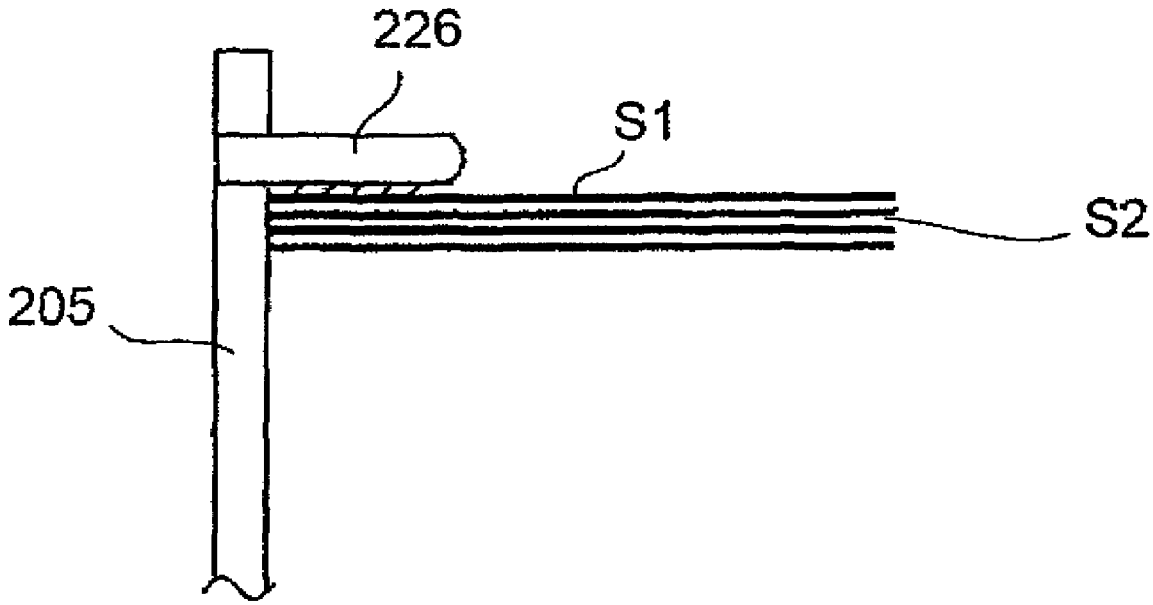
FIG. 7 is a diagram showing an operation of a rear end pressing member of a rear end restricting member provided on the sheet feeding device.
Figure 7B:
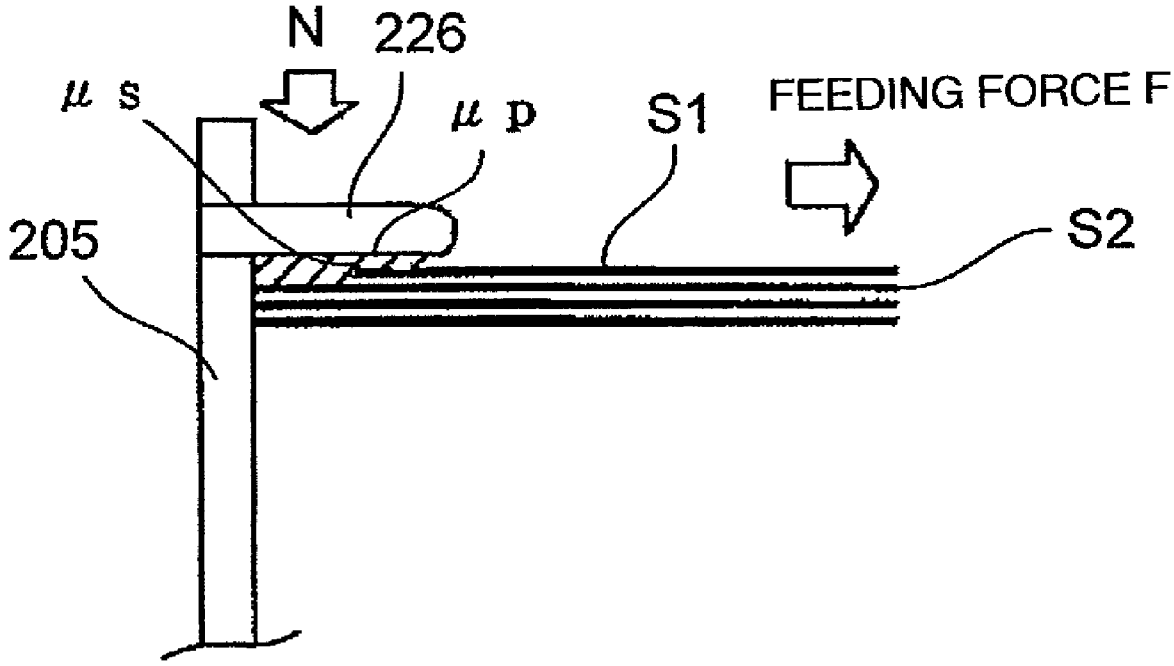
Figure 7C:
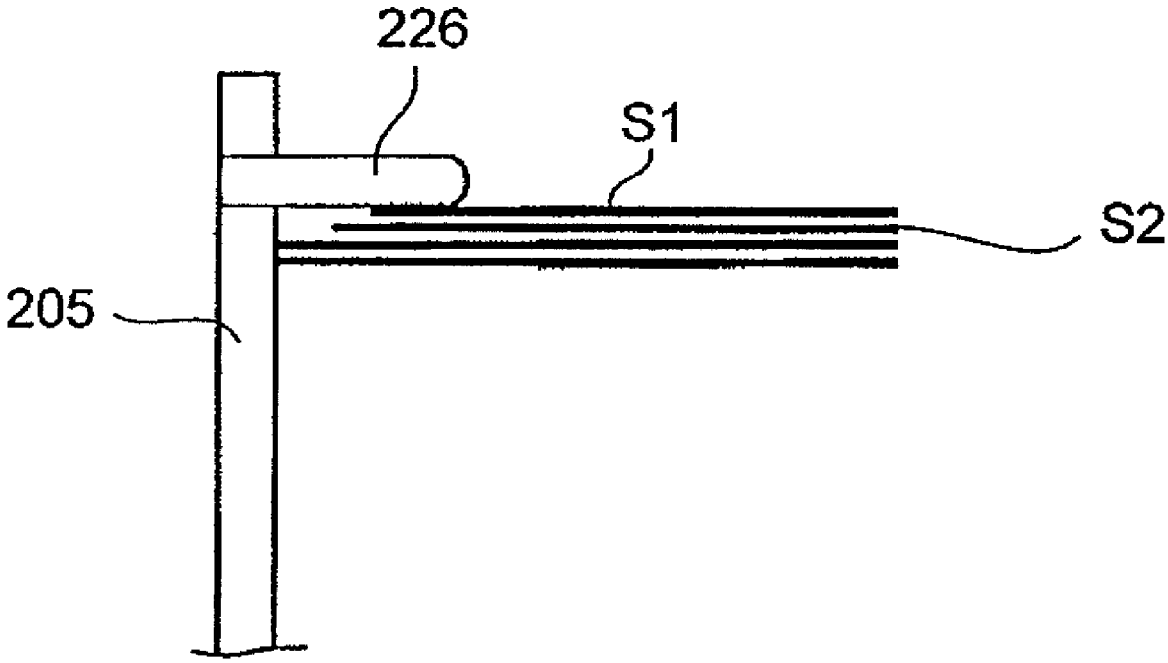

If a relation of $\mu p\cdot N<\mu s\cdot N$ is presented, when the topmost sheet S1 is conveyed by the suction conveyance belt 213 by suction, a second sheet S2 is conveyed to the downstream together with the sheet S1 as shown in FIG. 7(*c*), thereby possibly plural sheets being conveyed in an overlapping state.

If μp·N>μs·N is presented, when the topmost sheet S1 is conveyed by the suction conveyance belt 213, the second sheet S2 is never conveyed together due to frictional resistance on the rear end pressing member 226 whereby preventing plural sheets from being conveyed in the overlapping state.

Thus, to prevent conveyance of plural sheets in an overlapping state, the surface of the rear end pressing member 226 is set higher than the friction force μmax (usually, 0.55-0.6) between the sheets whose surface is rough.

Figure 9:
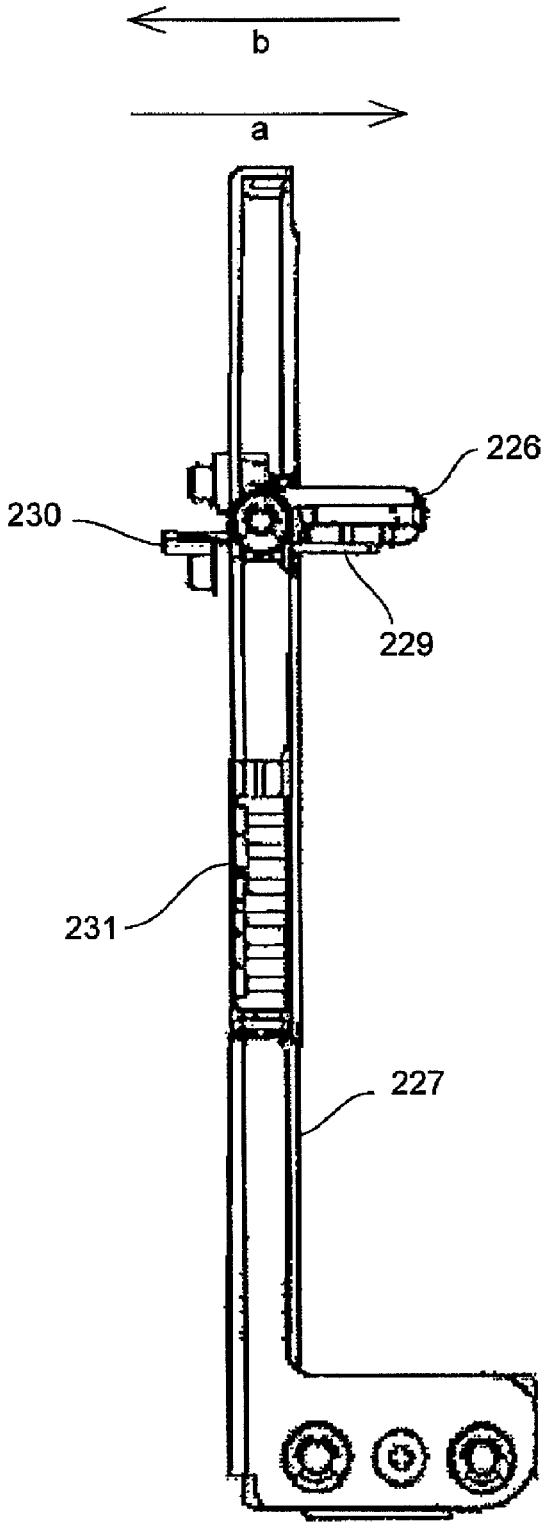
FIG. 9 is a side view of the rear end restricting member.

A resistance member 229 shown in FIG. 9 is mounted on the bottom face of the rear end pressing member 226 which serves as a contacting face relative to the sheet S1 of the rear end pressing member 226. In order to restrict a moving of the sheet S in a direction of leaving the rear end restricting member 205, as such a resistance member 229, a brush-like member whose surface is fuzzy is mounted such that the direction of the fuzz is opposite to the conveyance direction. Additionally, it is permissible to mount a member having surface resistance such as rubber material and viscous member. On the other hand, the sheet S1 moves sliding on the bottom face of the side pressing members 224, 225. To move the sheet smoothly, at least the bottom face of the side pressing members 224, 225 needs to be of smooth face and formed difficult to charge electrically.

Figure 8:
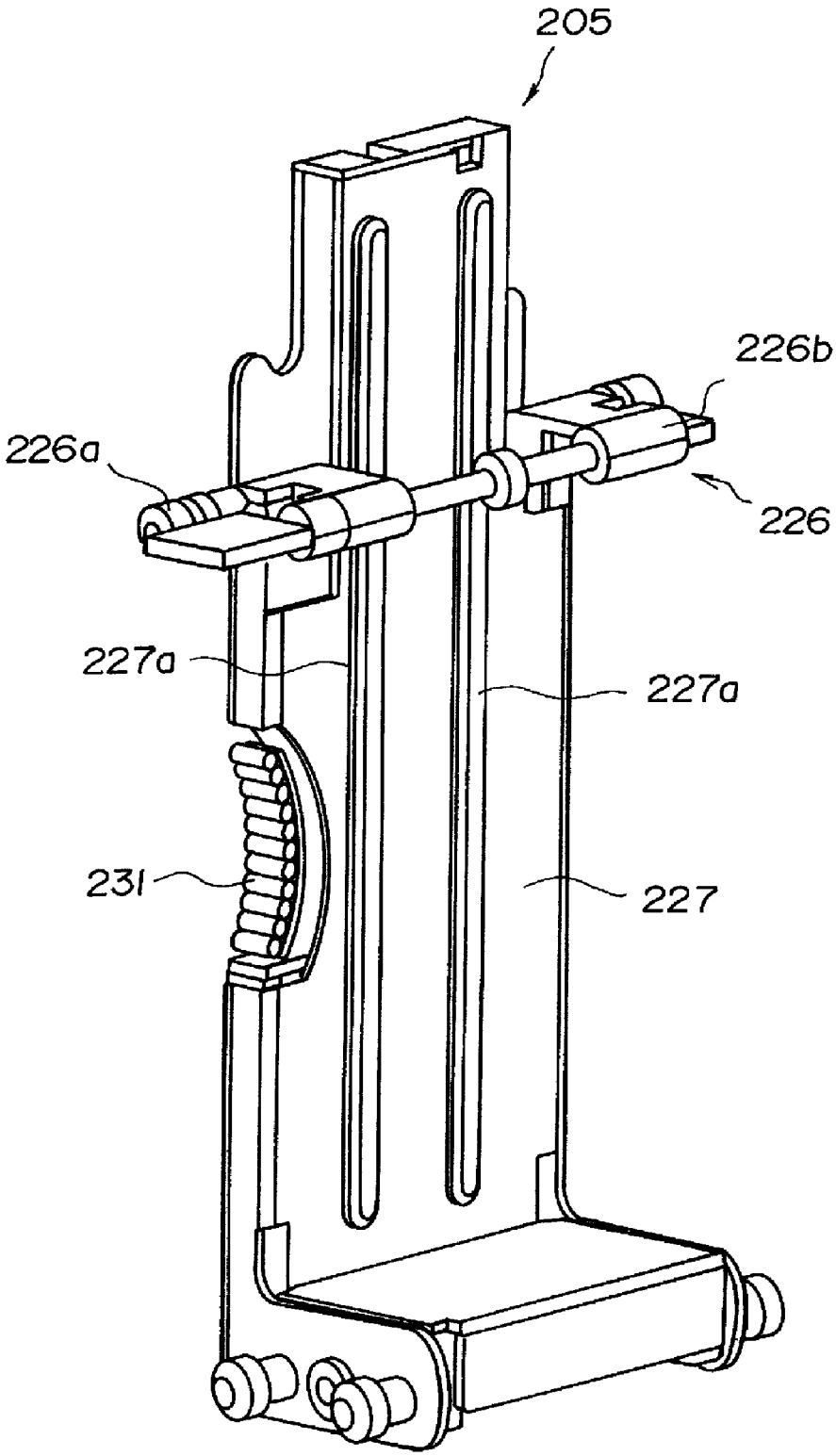
FIG. 8 is a perspective view of the rear end restricting member.

Next, the rear end restricting member 205 and a release mechanism which is a major portion of the present invention will be described with reference to FIG. 8 to FIG. 10. FIG. 8 is a perspective view of the rear end restricting member 205, FIG. 9 is a side view thereof and FIG. 10 is a diagram showing the structure of the release mechanism.

As shown in FIGS. 8 and 9, the rear end restricting member 205 is provided with the rear end restricting guide 227 constituting a contacting face which contacts the rear end face of the stacked sheets S for guiding the sheets. The surface of the rear end restricting guide 227 which constitutes the contacting face has a plurality of ribs 227*a* in order to reduce contact resistance when the sheet S sucked by the sheet suction duct 212 is lifted up.

Figure 10:
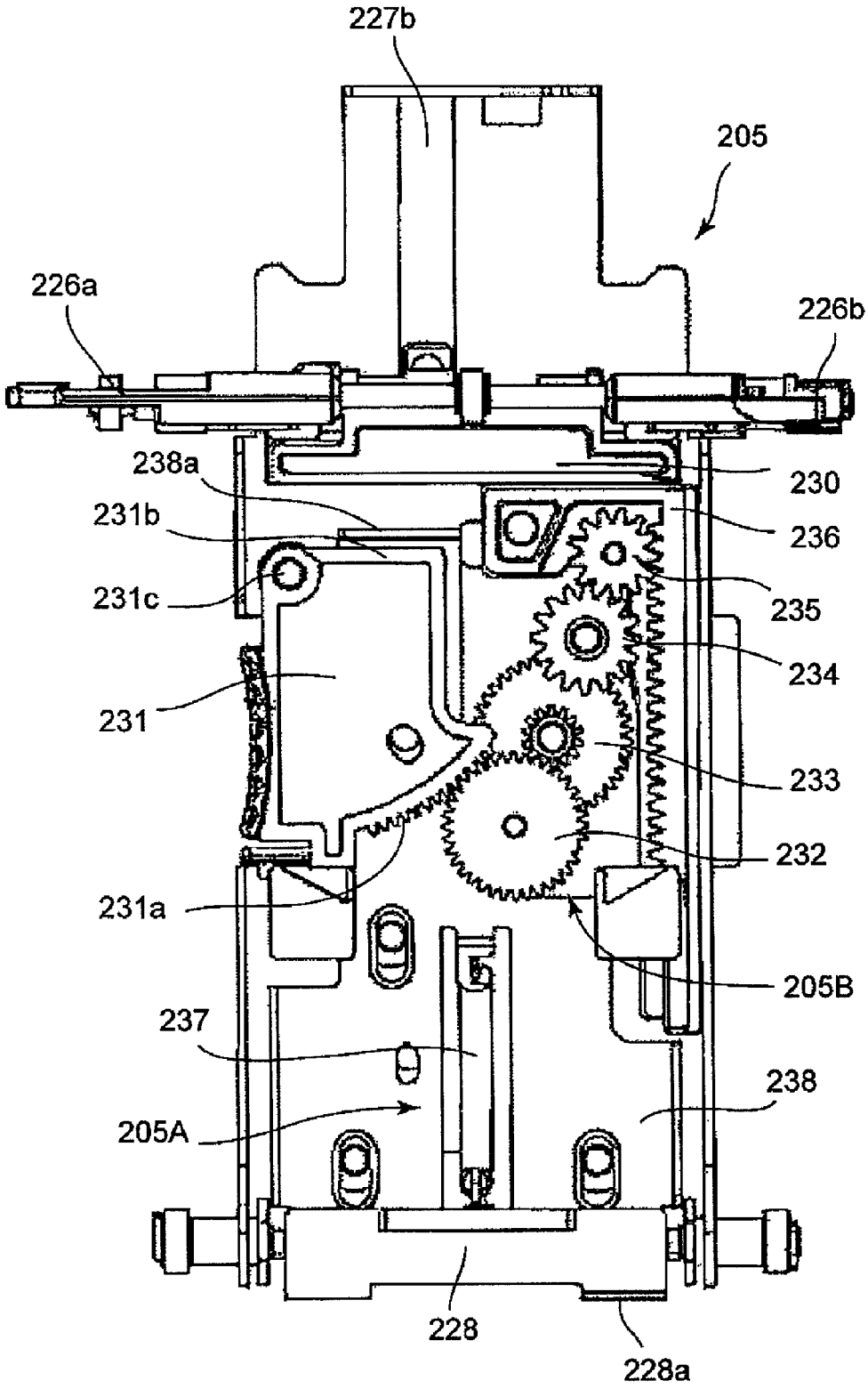
FIG. 10 is a diagram showing the interior structure of the rear end restricting member.

The rear end restricting member 205 is provided with a moving restricting stopper 228 which is a holding portion shown in FIG. 10 such that it can be moved vertically, in order to fix the rear end restricting member 205 after it is moved in sheet feeding directions indicated with arrows a, b.

This moving restricting stopper 228 has a tooth portion 228*a* which engages a tooth portion of a rail (not shown) provided on a frame member bottom portion removably in order to correspond to plural sizes. Then, by moving the moving restricting stopper 228 vertically, the rear end restricting member 205 can be moved and fixed (held) with respect to the tray 201.

A moving restricting stopper base 238 has the moving restricting stopper 228 at the bottom end. This moving restricting stopper base 238 is urged in a downward direction by a bottom portion pulling spring 237 so as to engage the tooth portion 228*a* of the moving restricting stopper 228 with the tooth portion of the rail provided on the frame member bottom portion securely.

Further, the rear end restricting member 205 is provided with the rear end pressing member 226 for pressing the rear end portion of the topmost sheet stacked as described above from its top face. In this embodiment, the rear end pressing member 226 is divided to two sections in the width direction as shown in FIG. 8 and these rear end pressing members 226*a*, 226*b* are connected by the rear end pressing slider 230 disposed on the rear face opposite to the contacting face of the rear end restricting guide 227. The resistance member 229 described above is mounted on the bottom faces of the two rear end pressing members 226*a*, 226*b*.

The rear end pressing slider 230 is provided slidably along a guide groove 227*b* extending in the vertical direction formed in the rear face of the rear end restricting guide 227. Then, when the rear end pressing slider 230 is slid in the vertical direction, the rear end pressing members 226*a*, 226*b* can be moved vertically along the contacting face of the rear end restricting guide 227, so that height positions of the rear end pressing members 226*a*, 226*b* can be changed.

In FIG. 10, an operation knob 231 is provided on the rear end restricting member 205 which can be rotated with respect to a shaft 231*c*. This operation knob 231 is used for operation for releasing an engagement of the tooth portion 228*a* of the moving restricting stopper 228 and withdrawal operation of lifting up the rear end pressing members 226*a*, 226*b* via the rear end pressing slider 230.

This operation knob 231 has a spur tooth gear portion 231*a* and the spur tooth gear portion 231*a* is connected to a lift up/down rack 236 which contacts the bottom face of the rear end pressing slider 230 from below through idler gears 232-235.

A second release mechanism 205B for raising the rear end pressing members 226*a*, 226*b* above the stored sheets is constituted of the spur tooth gear portion 231*a*, the idler gears 232-235, the lift up/down rack 236 and the rear end pressing slider 230. On the other hand, an upper bent portion 231*b* of the operation knob 231 is in contact with a contacting portion 238*a* provided on the moving restricting stopper base 238 urged in the downward direction by the bottom portion pulling spring 237 from below. A first release mechanism 205A for moving the moving restricting stopper 228 interlocked with an operation of the operation knob 231 is constituted of the upper bent portion 231*b* of the operation knob 231, the contacting portion 238*a* and the bottom portion pulling spring 237.

Figure 11:
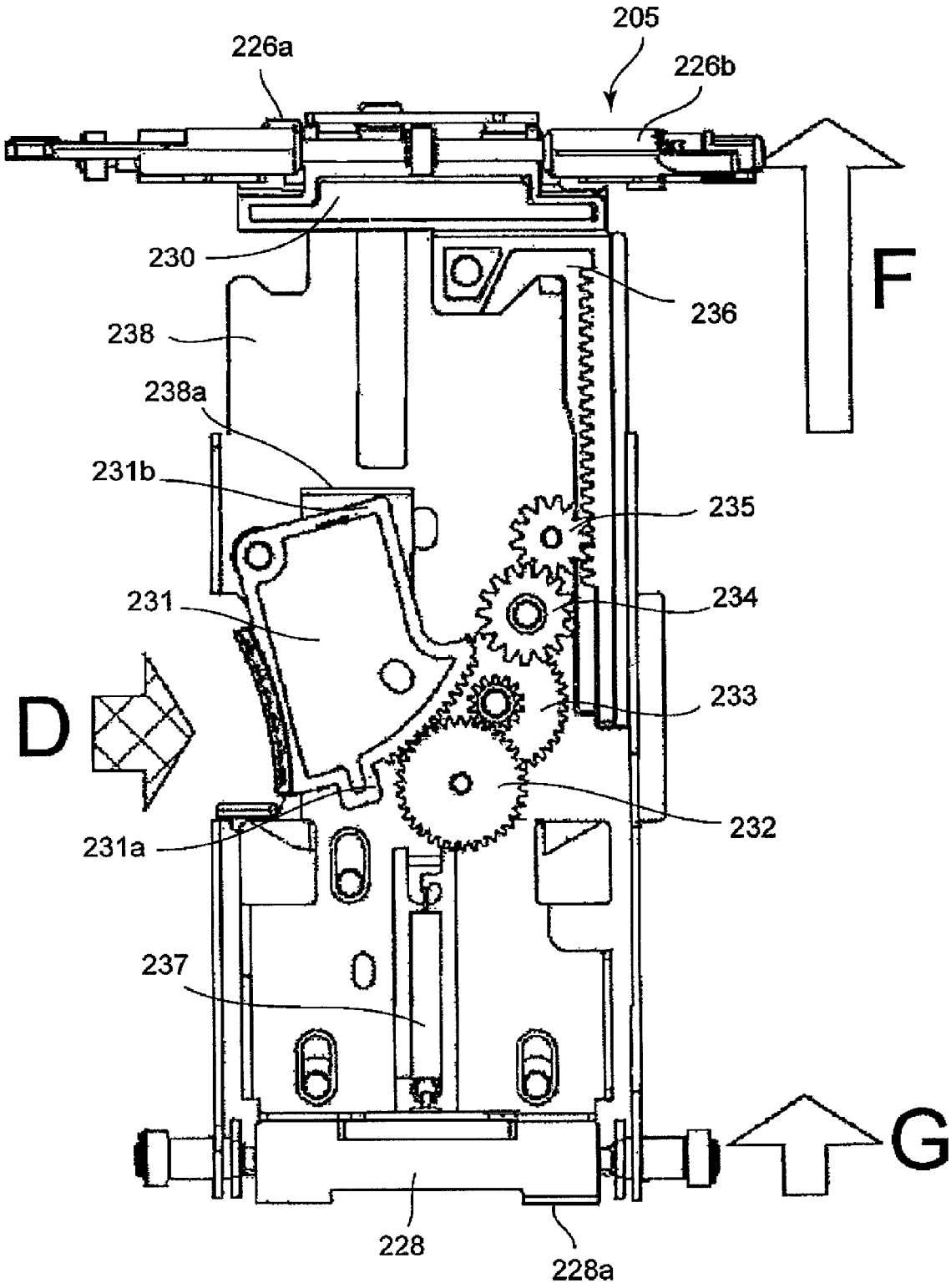
FIG. 11 is a diagram for describing an interior state of the rear end restricting member when an operation knob is operated.

When the operation knob 231 is pushed in a direction of an arrow D, for example, by gripping with the fingers as shown in FIG. 11, the lift up/down rack 236 is raised in a direction of an arrow F by the spur tooth gear portion 231*a*, so that the rear end pressing slider 230 is lifted up. Consequently, the rear end pressing members 226*a*, 226*b* are raised so that they move upward of the top face of the sheets stacked on the tray 201 as shown in FIG. 12.

The moving restricting stopper 228 is raised in a direction of arrow G which is an engagement release direction indicated in FIG. 11 together with the moving restricting stopper base 238 by the upper bent portion 231*b* of the operation knob 231 at the same time, so that the tooth portion 228*a* of the moving restricting stopper portion 228 is detached from the tooth portion of the rail.

Figure 12:
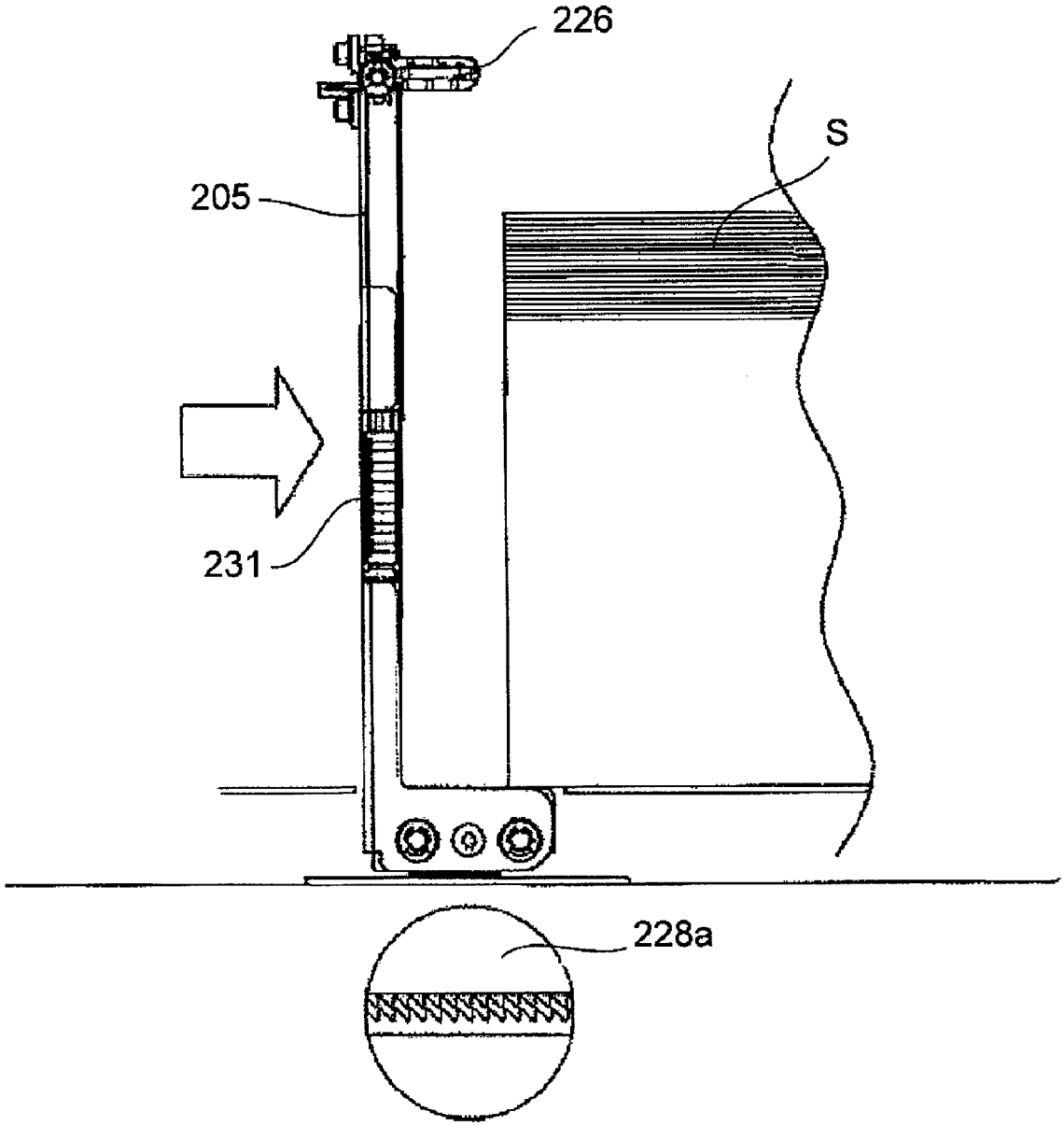
FIG. 12 is a side view showing states of the rear end pressing member and move restricting member when the operation knob is operated.
Figure 13:
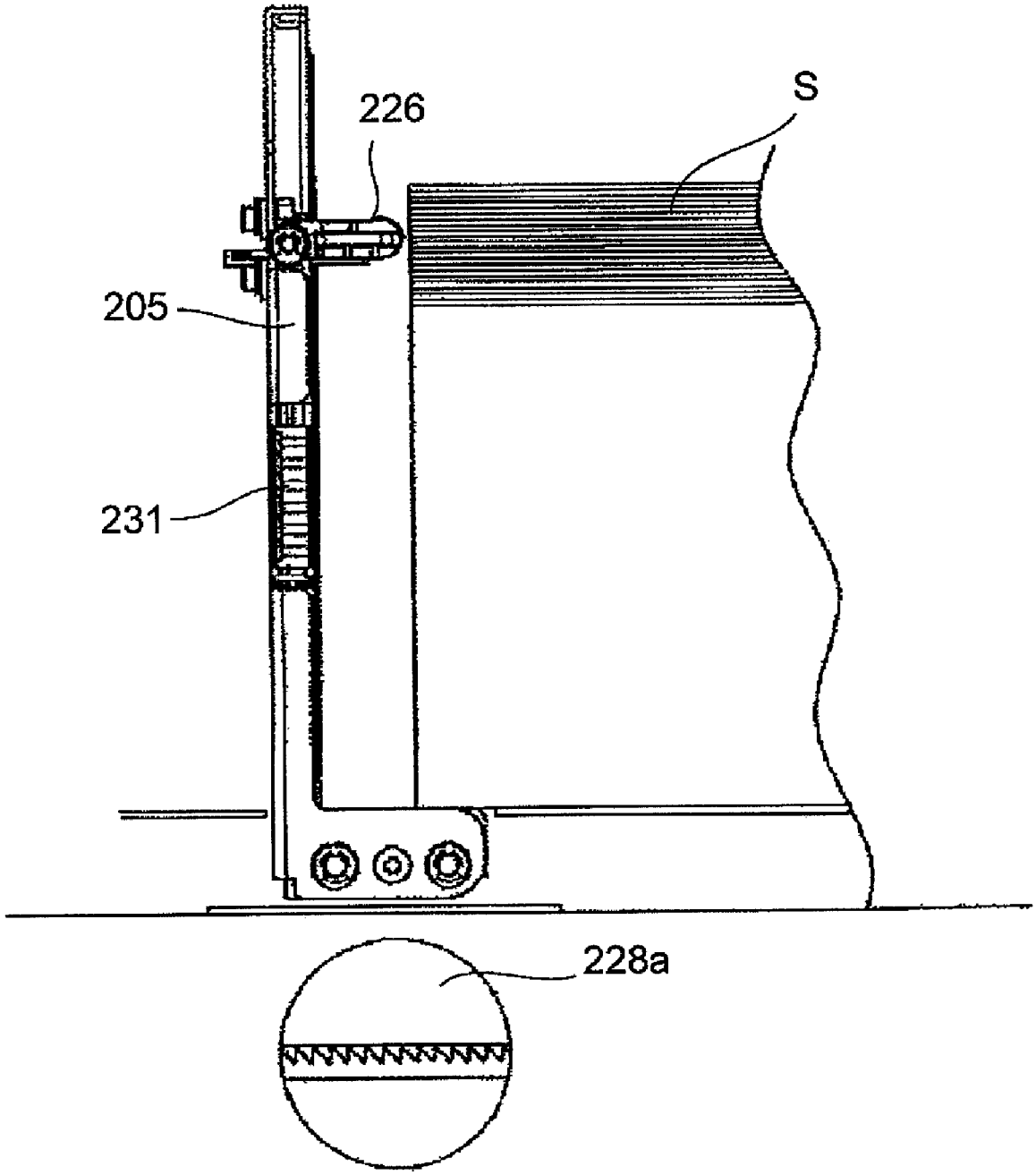
FIG. 13 is a side view showing states of the rear end pressing member and move restricting stopper before the operation knob is operated.

That is, according to this embodiment, when the operation knob 231 is pushed in the direction of arrow D, holding of the moving restricting stopper 228 is released as shown in FIG. 12 so that the rear end restricting member 205 turns into a state allowing it to move in the sheet feeding direction. At the same time, the rear end restricting members 226*a*, 226*b* are lifted up so that they are raised to a position sufficient apart from the top face of the topmost sheet S1. Consequently, when the moving restricting stopper 228 is moved, it is possible to prevent the rear end pressing members 226*a*, 226*b* from interfering with the end face of the stacked sheets S as shown in FIG. 13.

Figure 14:
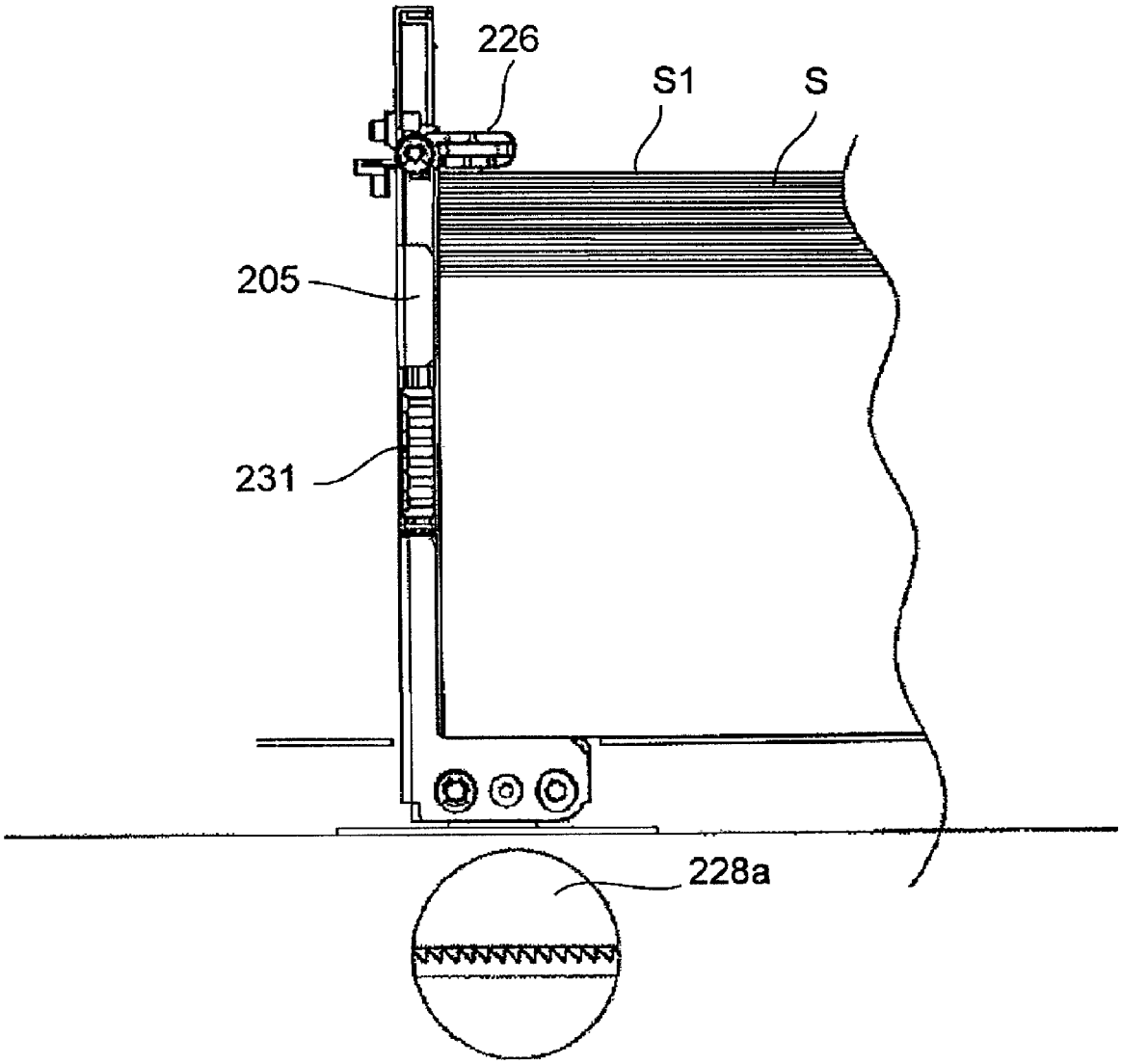
FIG. 14 is a side view showing states of the rear end pressing member and move restricting stopper after the operation knob is operated.
Figure 15A:
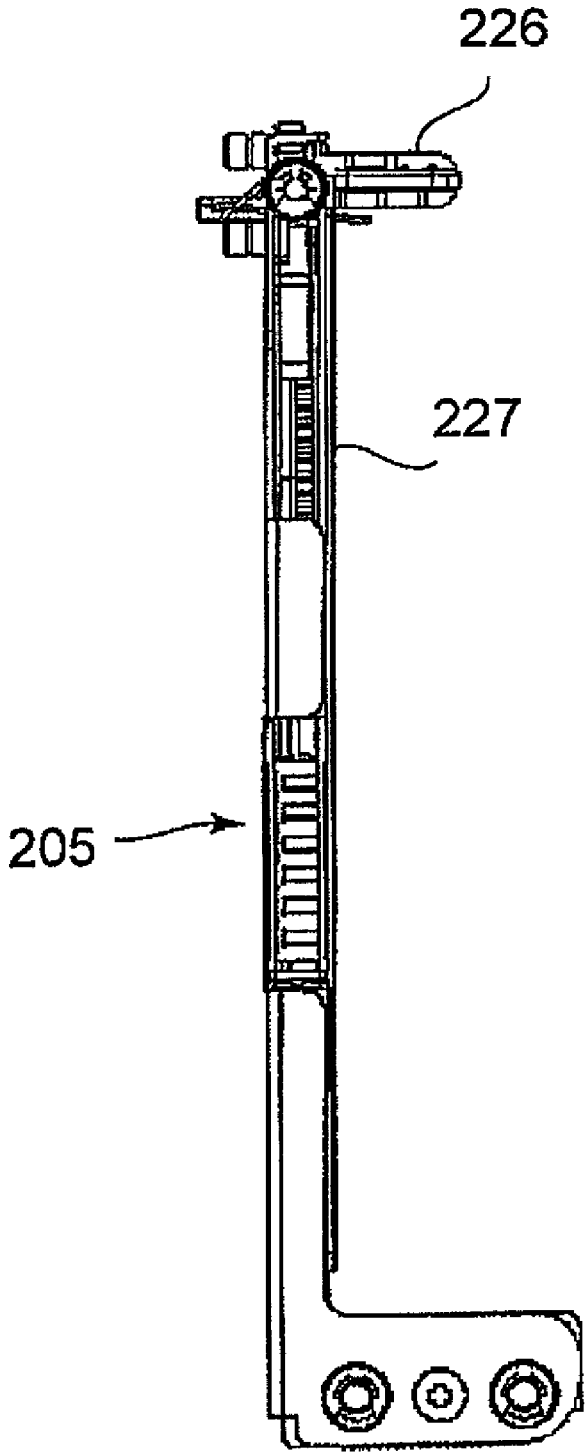
FIG. 15 is a diagram for describing other structure of the rear end pressing member.
Figure 15B:
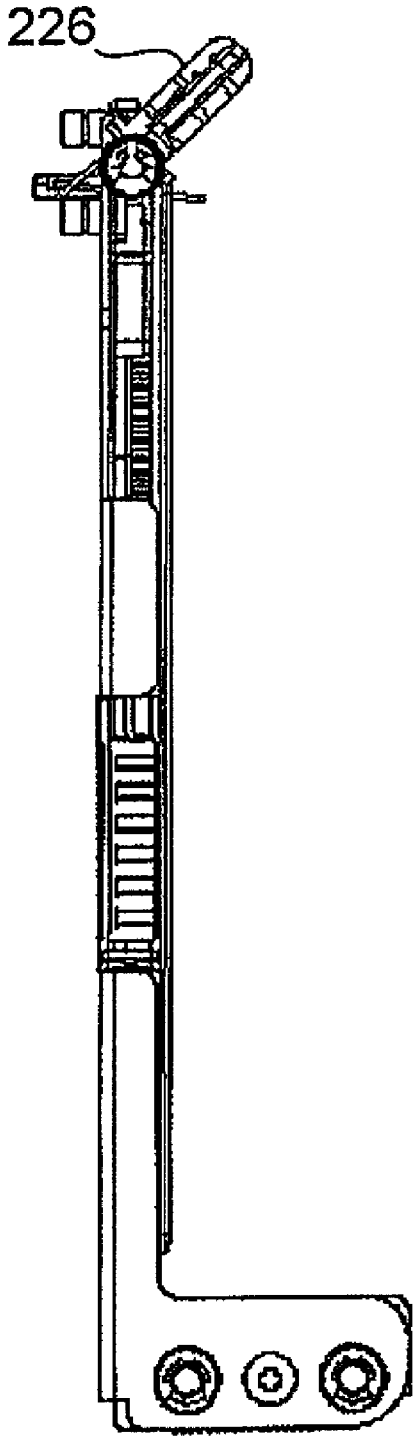
Figure 15C:
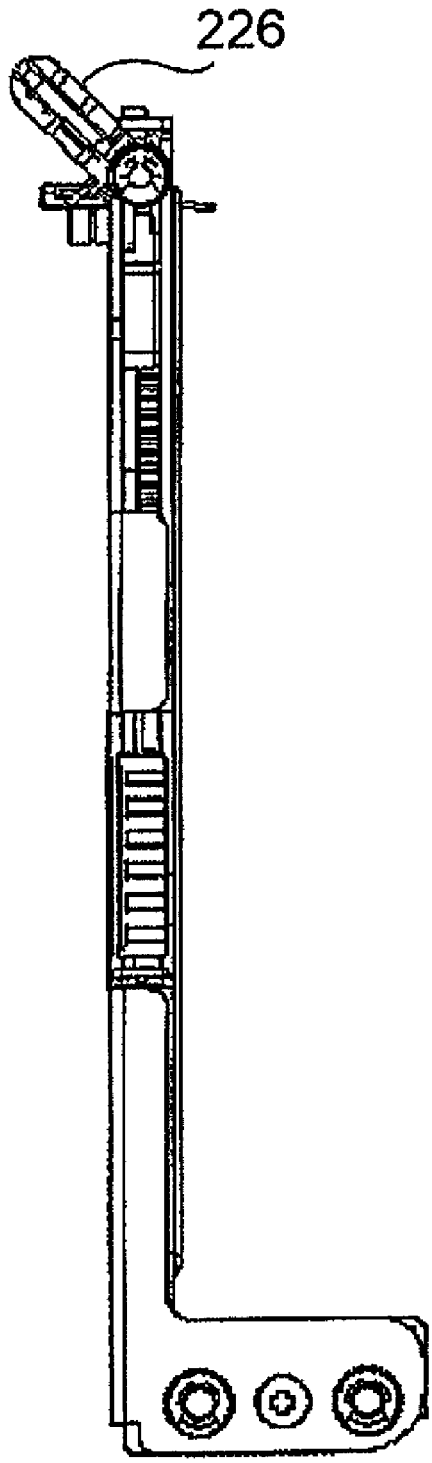
Figure 15D:
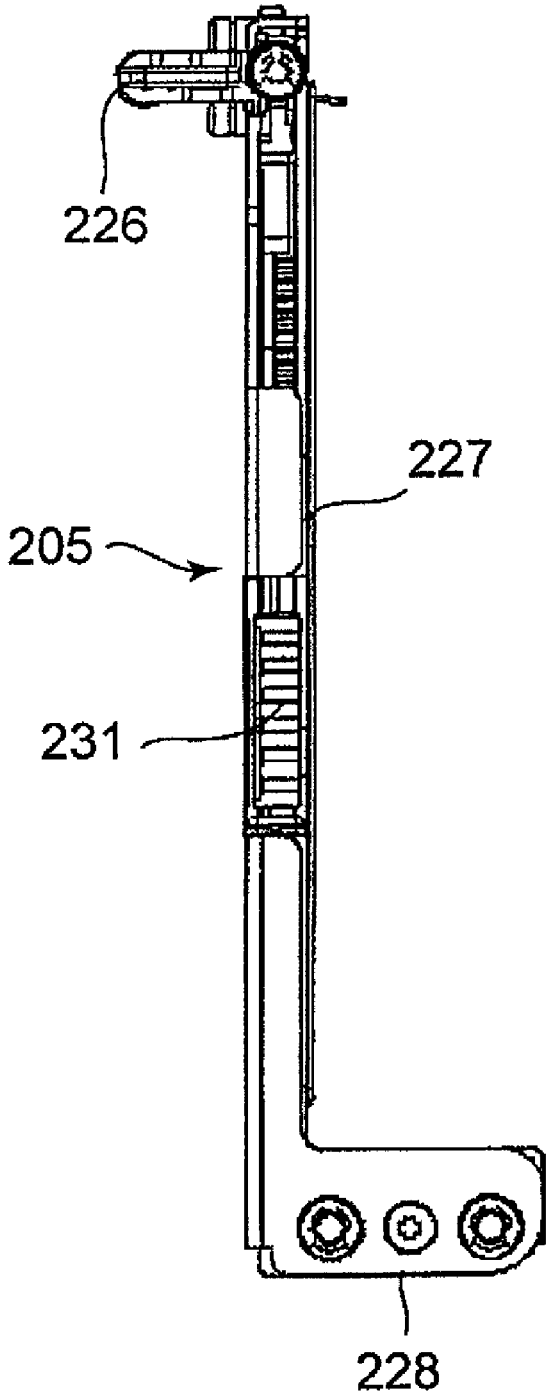

In the meantime, when the finger is released from the operation knob 231, the operation knob 231 is rotated in an opposite direction to the arrow D by weights of the lift up/down rack 236 and the moving restricting stopper base 238. As a result, although the lift up/down rack 236 is lowered, the rear end pressing members 226*a*, 226*b* contact the topmost sheet S1 from above as shown in FIG. 14, so that the rear end portion of the sheet S can be pressed securely.

After the moving restricting stopper 228 comes into contact with the topmost sheet S1 from above, the moving restricting stopper base 238 is lowered and consequently, the tooth portion 228*a* of the moving restricting stopper 228 engage the tooth portion of the rail provided on the frame member bottom portion.

When moving the rear end restricting member 205, the moving restricting stopper 228 is moved in the direction of releasing the engagement by operating the operation knob 231 and the rear end pressing members 226*a*, 226*b* can be raised above the sheets S stacked on the tray 201. Consequently, operability upon loading of the sheets is improved. Further, an error in set operation after the sheets are stacked can be prevented and because the upper limit height of stacked sheets can be raised, the stacking capacity can be increased.

Further by pressing the sheets with the rear end pressing members 226*a*, 226*b*, sheets having various physical property such as thickness of the sheet, surface nature, difference in stiffness can be conveyed stably without being affected by curl generated in the sheet due to use environment such as temperature and humidity.

Although in this embodiment, the rear end restricting members 226*a*, 226*b* and the moving restricting stopper 228 are lifted up/down by a gear string from the operation knob 231 and lever action, the same effect can be obtained using wire or electronic components solenoid, small-size motor.

Although in the above description, the rear end pressing member 226 is described to be movable only in the vertical direction, the present invention is not restricted to this example. For example, it is permissible to lift up the rear end pressing member 226 up to the top end of the rear end restricting guide 227 by operation of the operation knob 231 as shown in FIG. 15(*a*) and further rotate it by 180° as shown in FIGS. 15(*b*)-(*d*).

The rear end pressing member 226 can be withdrawn from the top of the tray 201 by rotating it at the top end of the rear end restricting guide 227 by 180°, the sheets can be stacked on the tray from above. As a result, ease of stacking of the sheets is improved.

Although in FIG. 15, the rear end pressing member 226 is rotated by 180° at the top end of the rear end restricting guide 227 (rear end restricting member 205), the same effect can be obtained if the rear end pressing member 226 is rotated upward by 90° or more.

Although in the description of this embodiment, a case of applying the present invention to the rear end restricting member for restricting the position of the rear end of the sheet has been described, the present invention is not restricted to this example. For example, the present invention may be applied to the side pressing members 224, 225 provided on a width direction restricting member for restricting the side ends (ends in a direction perpendicular to the sheet feeding direction) of the sheet.

Although in the above description, a case where the sheet feeding device of the present invention is applied to an ordinary image forming apparatus has been described, the present invention is not restricted to this example. For example, the present invention may be applied to an image forming apparatus having a sheet processing device for carrying out a predetermined processing (for example, boring, bending, surface treatment, binding and other sheet processings) to sheets fed one by one. Further, the sheet feeding device provided on this image forming apparatus may be provided with a sheet feeding device of the present invention.

This application claims the benefit of Japanese Patent Application No. 2006-280658 filed Oct. 13, 2006, which is hereby incorporated by reference herein in its entirety.

What is claimed is:

1. A sheet feeding device for feeding a sheet while loosening the sheet by blowing air to end portions of the stacked sheets accommodated in a sheet storage portion, comprising:

a restricting member provided movably in the sheet storage portion which restricts the position of the stacked sheets accommodated in the sheet storage portion;

a holding portion which holds the restricting member at a restricting position corresponding to a sheet size of the stacked sheets;

a pressing members provided movably in the vertical direction on the restricting member so as to press the top face of the stacked sheets restricted by the restricting member; and a release mechanism which releases holding of the restricting member by the holding portion to move the restricting member and moves the pressing member upward from the top face of the stacked sheets.

2. The sheet feeding device according to claim 1 wherein the release mechanism comprises an operation portion, a first release mechanism which releases the holding of the restricting member by the holding portion interlocked with an operation of the operation portion and a second release mechanism which moves the pressing member upward from the top face of the stacked sheets.

3. The sheet feeding device according to claim 2 wherein when the operation of the operation portion is terminated by moving the restricting member, the first release mechanism is returned to a position in which the holding portion holds the restricting member and the second release mechanism is returned to a position in which the pressing member presses the top face of an end portion of the stacked sheets.

4. The sheet feeding device according to claim 1 wherein the restricting member has a contacting face which contacts the end portion of the stacked sheet and the pressing member moves in a vertical direction along the contacting face.

5. The sheet feeding device according to claim 4 wherein the pressing member is rotatable by 90° or more with the top end of the restricting member acting as a fulcrum point, after it is moved upward along the contacting face interlocked with an operation of the operation portion.

6. The sheet feeding device according to claim 1 wherein the contact face making contact with the top face of the sheet of the pressing member is provided with a resistance member for restricting moving of the sheet in a direction of departing from the restricting member.

7. An image forming apparatus including a sheet feeding device for feeding a sheet while loosening the sheet by blowing air to end portions of the stacked sheets accommodated in a sheet storage portion and an image forming portion for forming an image on a sheet fed from the sheet feeding device, the image forming apparatus comprising:

a restricting member provided movably in the sheet storage portion which restricts the position of the stacked sheets accommodated in the sheet storage portion;

a holding portion which holds the restricting member at a restricting position corresponding to a sheet size of the stacked sheets;

a pressing members provided movably in the vertical direction on the restricting member so as to press the top face of the stacked sheets restricted by the restricting member; and a release mechanism which releases holding of the restricting member by the holding portion to move the restricting member and moves the pressing member upward from the top face of the stacked sheets.

8. The image forming apparatus according to claim 7 wherein the release mechanism comprises an operation portion, a first release mechanism which releases the holding of the restricting member by the holding portion interlocked with an operation of the operation portion and a second release mechanism which moves the pressing member upward from the top face of the stacked sheets.

* * * * *